US007232200B2

(12) United States Patent
Nakahanada et al.

(10) Patent No.: US 7,232,200 B2
(45) Date of Patent: Jun. 19, 2007

(54) IMAGE FORMING APPARATUS AND METHOD FOR FORMING IMAGE

(75) Inventors: Manabu Nakahanada, Hachioji (JP); Atsushi Suzuki, Hachioji (JP); Takashi Deguchi, Sagamihara (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 295 days.

(21) Appl. No.: 10/995,504

(22) Filed: Nov. 24, 2004

(65) Prior Publication Data

US 2005/0116980 A1 Jun. 2, 2005

(30) Foreign Application Priority Data

Nov. 28, 2003 (JP) ..... 2003-399193

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 5,353,052 A * 10/1994 Suzuki et al. ..... 347/19
5,946,006 A * 8/1999 Tajika et al. ..... 347/19
6,406,116 B1 * 6/2002 Katakura et al. ..... 347/15
6,454,390 B1 * 9/2002 Takahashi et al. ..... 347/41
6,876,467 B1 * 4/2005 Yamaguchi ..... 358/1.9
2002/0021321 A1 * 2/2002 Nakajima et al. ..... 347/19

* cited by examiner

*Primary Examiner*—Stephen Meier
*Assistant Examiner*—Jason Uhlenhake
(74) *Attorney, Agent, or Firm*—Finnegan, Henderson, Farabow, Garrett & Dunner, L.L.P.

(57) ABSTRACT

An image forming apparatus comprises a recording head having a plurality of recording elements arranged in array, the recording head being utilized for recording a corrective image onto a recording material, an image reading device to acquire readout information by reading the corrective image, an carrying out section to conduct calculation to obtain a correction amount of recording characteristics, from the readout information acquired by the reading device, an image forming section to form an image onto the recording material by the recording head in which a recording characteristics of the plurality of recording elements are compensated based on the correction amount, and a controller to control the recording head so as to record the corrective image on to the recording material, wherein, the readout information in the carrying out section discriminates optical density unevenness caused by a factor not being associated with the recording head.

46 Claims, 7 Drawing Sheets

| EXISTENCE OF DIRT | NO-DIRT | EXISTENCE OF A DIRT | EXISTENCE OF A DIRT |
|---|---|---|---|
| RELATED STEP | S7 NO | S7 YES<br>S8 NO | S8 YES |
| STEPS OF EXECUTION | NORMAL CORRECTING CALCULATION | CORRECTING CALCULATION AFTER REMOVING DIRTY PORTION | STOP CORRECTING CALCULATION |

IMAGE FORMING APPARATUS AND METHOD FOR FORMING IMAGE

TECHNICAL FIELD

The present invention relates to an image forming apparatus and a method for forming an image.

BACKGROUND

In recent years, the enhanced printing capability and the improved performance of an image quality of a miniature digital developing apparatus as a digital output apparatus have increased broadly due to the popularity of digital cameras. Especially, there is a strong demand for improving the quality of larger image prints and many development reports of an exposing apparatus employing a recording head with a plurality of recording elements deployed in an array for this purpose are known.

Generally, since a light emitting recording element structuring the described array-type recording head has an its own respective light emitting characteristic, when the correction of the light emitting characteristic is not adequate, optical density unevenness on an image results and is recorded when printed. As a result, it lowers the commercial value of the image. Unevenness of each recording element is generally from 20% to 40%. In order to express a photograph by continuous optical density, unevenness of each recording element has to be no more than 2%, and when a higher quality image is desired, it should be less than 1%. In regard to correction of unevenness of a recording element, for example, Japanese Patent Open to Public Inspection: Nos. H08-230235 and H10-811 disclose those techniques.

However, according to those references, following drawbacks tends to occur.

Generally, a miniature digital developing apparatus contains a chemical storage tank for a processing solution and applies the processing solution onto a recording material (hereinafter, a photosensitive material is used in many cases but is not limited to a photosensitive material) for a developing process to form an image. Generally, since heated processing solution circulates in the chemical solution tank in order to minimize the processing time, ambient oxygen easily oxidizes the processing solution and it generates a useless ingredient. This useless ingredient accumulates in the conveyance path in the developing section and is transferred onto the photosensitive material. As a result, it appears on the photosensitive material as optical density unevenness, namely dirt generated by the factor of other-than the recording of a recording head. Recently, since the duration of processing tends to be rather lengthy, it is generally when the transferring of dirt tends to occur. Other than the situation described above, unevenness caused by the development unevenness generated by evaporation of water-drops adhering in the conveyance path also appears as dirt generated by a factor other than during recording by the recording head.

Additionally, even if optical density unevenness is caused by adhesion of dirt in a development section to photosensitive material as described above and/or the unevenness of development itself, optical density unevenness is accidentally recognized to be caused by optical density unevenness associated with a recording head and a feedback to the recording head is performed.

Consequently, in the current system, when adhesion of dirt and/or development unevenness occurs, it is often an inconvenience in that optical density unevenness appears in places where no optical density unevenness exists as a result of a correction, since the correction, which should not be conducted, is performed. It is called reverse correction and occasions of optical density unevenness increases instead of decreasing.

Since in almost all cases, optical density unevenness correction is performed as part of a warm-up process before full operation of the apparatus, optical density unevenness correction is performed when the possibility of development unevenness such as dirt adhesion after an overnight down time of the apparatus. Consequently, even in a situation where an unevenness correction is unnecessary, the correction is conducted, as in the situation described above, and as a result so-called reverse correction is conducted.

Accordingly, it becomes a situation where several corrections are necessary to correct the reverse correction. Under these circumstances, since the warming-up time becomes too long, it degrades not only the operation efficiency of a miniature digital developing apparatus but also results in mental stress of the operator identical to the operations for correcting optical density unevenness are required. This can also develop into a problem which decreases operator job satisfaction.

SUMMARY

An object of the present invention is to provide an image forming method and an image forming apparatus capable of performing appropriate correction even if there is optical density unevenness caused by a factor other than the recording head.

In accordance with an aspect of the present invention, a method of forming an image employing an image reading device and a recording head having a plurality of recording elements arranged in array, the method comprises the steps of recording a corrective image onto a recording material, acquiring readout information from the corrective image read by the reading device, and carrying out a calculation to obtain an amount of a correction for recording characteristics, each of which corresponds to each of the plurality of recording elements, from the readout information acquired in the acquired step, and forming an image onto the recording material by the recording head in which the plurality of recording elements are compensated based on the amount of correction in the carrying out step, wherein, the readout information in the acquiring step discriminates optical density unevenness caused by a factor not being associated with the recording head based on the readout information.

A readout information means here information representing optical density which is read by an image reading apparatus or numerical information calculated based on the optical density. It may be optical density itself, reflectivity, transmittance, absorbance, etc., a functional value being paired with those items described, for example, a logarithmic value or a statistic value of those item described. Or when an image is read by the image reading apparatus such as an image reading device, the readout information may be the signal value which is measured by the image reading apparatus, a functional value being paired with those items described or a relative value of those items described.

In addition, optical density unevenness caused by the factor not being associated with a recording head means here, for example, optical unevenness caused by factors other than optical density unevenness caused by the reason that the adjustment of the recording characteristics of a recording head, such as adhesion of dir in the processing unit, pressure marks of a photosensitive material, images formed by a leaked light in a printing section and painting unevenness of photosensitive material.

In accordance with another aspect of the present invention, the amount of the correction is calculated without optical density unevenness when the optical density unevenness caused by a factor not being associated with the head is identified.

Further, although "without optical density unevenness" means, here to separate optical density unevenness caused by the factors not being associated with a recording head, which includes that optical density unevenness caused by the recording head is appropriately extracted and compensated.

In accordance with another aspect of the present invention, the optical density unevenness is discriminated based on a statistic value of the readout information.

As a statistic value, a value representing the entire aspect of a distribution characteristic such as an average value, a median, a quartile deviation, a mode and a mean squire, etc, are preferable.

In accordance with another aspect of the present invention, the optical density unevenness is discriminated based on a determination whether the readout information is equal to or more than a predetermined threshold.

In regard to a threshold, although, it may be one, plural thresholds are preferable. When there are plural thresholds, it is preferable that comparison is conducted by appropriately combining those thresholds. Further, when there are basic colors R, G and B, there may be plural thresholds for each color.

In accordance another aspect of the present invention, the optical density unevenness is discriminated based on a comparison of optical density in the readout information obtained from different areas of the recording material.

"Different areas" means here different locations on a chart. It is preferable that different areas present different readout information, and each area has different level of optical density.

In accordance with another aspect of the present invention, an method of image forming employing an image reading device and a recording head having a plurality of recording elements arranged in array, the method comprises the steps of recording a corrective image onto a recording material, acquiring readout information from the corrective image read by the reading device, obtaining a difference of readout information between different areas of the recording material on which the corrective image is recorded, carrying out a calculation to obtain an amount of correction without the readout information when the difference falls within a range from a predetermined first threshold to a predetermined second threshold being larger than the first threshold, stopping the calculation when the difference is equal to or more than the second threshold, and forming an image onto the recording material by the recording head in which the plurality of recording elements are compensated based on the amount of correction in the carrying out step.

In accordance with anther aspect of the present invention, a method of image forming employing an image reading device and a recording head having a plurality of recording elements arranged in array, the method comprises the steps of, recording a corrective image onto a recording material, acquiring readout information of non-recorded section of the recording material on which the corrective image is recorded which is read by the image reading device, determining whether there is dirt in the non-recorded section of the recording material on which the corrective image is recorded based on the readout information, carrying out a calculation to obtain an amount of correction when determined that there is no dirt in the recording material on which the corrective image is recorded; stopping the calculation when determined that there is dirt in the recording material on which the corrective image is recorded, and forming an image onto the recording material by the recording head in which the plurality of recording elements are compensated based on the amount of correction in the carrying out step.

Non-recoding area means here, a-section as shown in FIG. 5, an area where the inclination of the characteristic curve of a photosensitive material is substantially zero and optical density does not increase even though an exposure of light increases. Namely, it means that an area where a recording head substantially cannot record an image. Dirt means here a matter which is transferred onto a photosensitive material from non-resolved ingredients of processing liquid accumulated on a conveyance path of a recording material while the photosensitive material is transported on the conveyance path, residual colors, and a color of Y-stain, etc. which ate unexpected to be. Pressure marks of photosensitive material and an image formed by a leak light in printing section are included in dirt.

DESCRIPTION OF THE PREFERED EMBODIMENT

An embodiment of the present invention will be described in detail by referring to drawings. However the scope of the present invention is not limited to these drawings. In addition, there are cases where limited expressions are used, however the present invention is not limited to these limited expressions.

Figure 1:
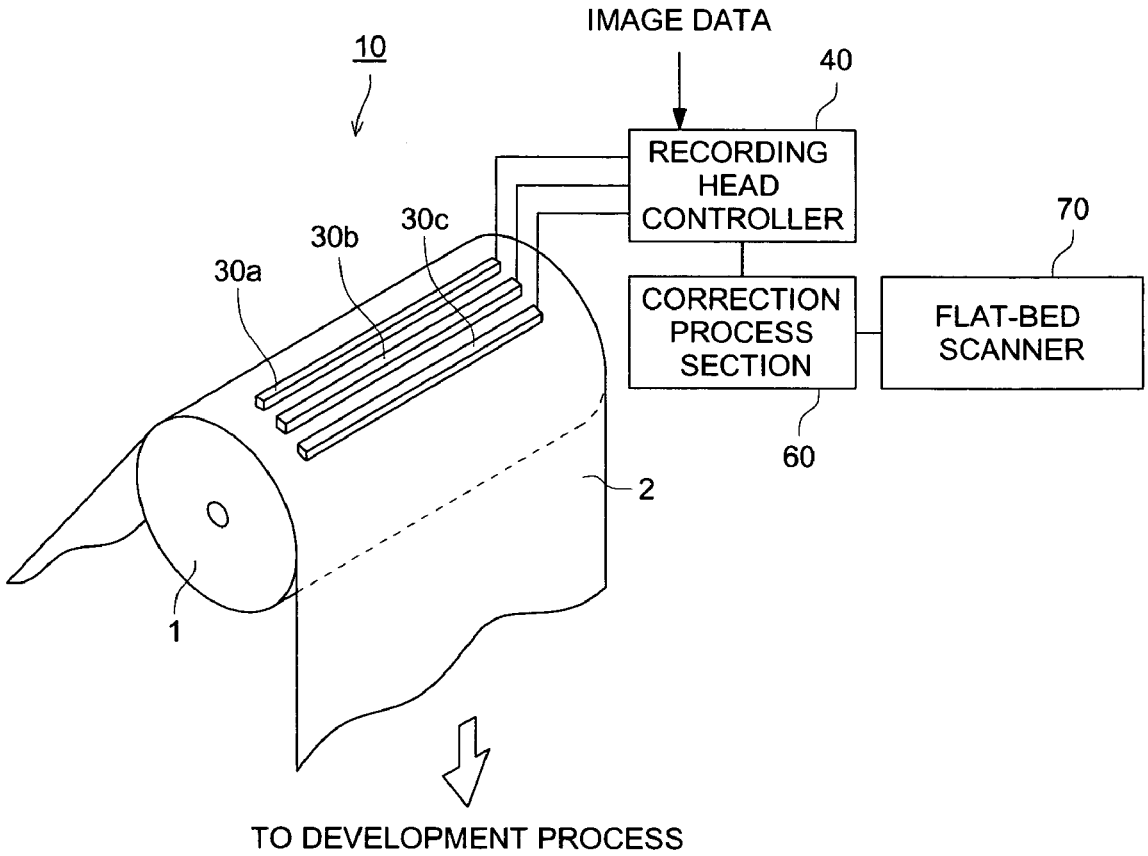
FIG. 1 shows a block diagram and part of an image forming apparatus as an embodiment of the present invention.

FIG. 1 shows a block diagram for image forming apparatus 10 as an embodiment of the present invention. As shown, image forming apparatus 10 comprises supporting drum 1, red recording head 30*a*, green recording head 30*b*, blue recording head 30*c*, recording head controller 40, correction process section 60 and flathead scanner 70, etc.

Supporting drum 1 is a conveyance device rotated by a driving source not shown. Supporting drum 1 conveys a color photographic printing paper sheet, being a silver halide photosensitive material as recording material 2 (a printing paper sheet) which is drawn from a roll not shown in the direction as shown by the arrow.

Figure 2:
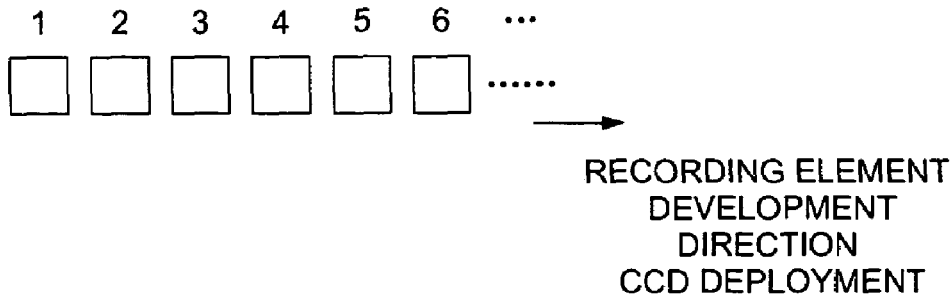
FIGS. 2(*a*), 2(*b*) and 2(*c*) show the deployment for recording elements of an arrayed recording head.
Figure 2:
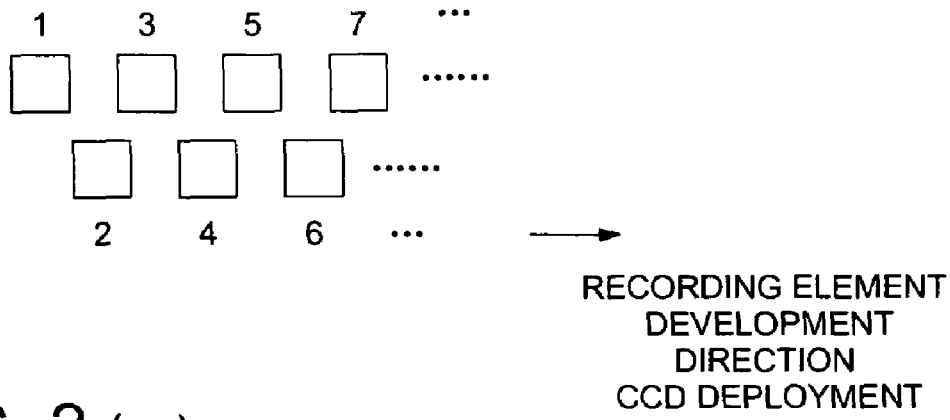
Figure 2:
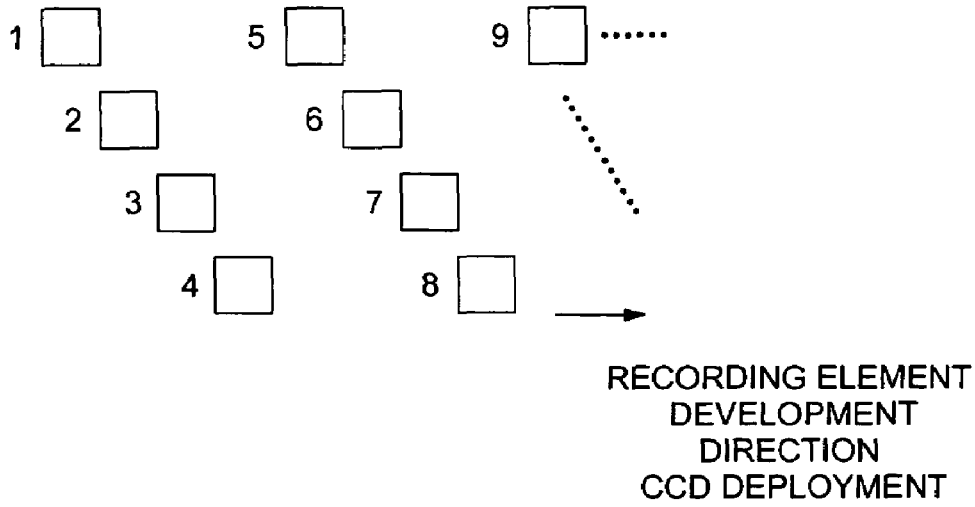

Red recording head 30*a*, green recording head 30*b* and blue recording head 30*c* are recording heads each of which has a plurality of arrayed recording elements. The array need not be linear shown in FIG. 2(*a*) but may be staggered as shown in FIG. 2(*b*) or a pattern as shown in FIG. 2(*c*). An identification number is given for each element as shown in FIGS. 2(*a*), 2(*b*) and 2(*c*). Adjacent elements here mean an element having the preceding or the following number. The recording element arrangement direction of recording head 30 is defined as the direction in which an element having a higher number is arranged as shown in FIGS. 2(*a*), 2(*b*) and 2(*c*).

In red recording head 30*a*, an LED (Light Emitting Diode) is employed as a light source, while in green recording head 30*b* and blue recording head 30*c*, employed is a VFPH (Vacuum Fluorescent Print Head) capable of simple color-separation via a color filter, and also exhibiting a relatively high luminance and high-speed response.

Recording head controller 40 controls red recording head 30*a*, green recording head 30*b* and blue recording head 30*c* by sequential shifting of recording timing so that each recording head records each R, G and B image data at the predetermined positions on printing paper sheet 2.

Correction process section 60 calculates correction data as appropriate to correct the optical characteristics of red recording head 30*a*, green recording head 30*b* and blue recording head 30*c* from measured data indicating each optical density of colors R, G and B as inputted readout information from flatbed scanner 70.

Namely, correction process 60 functions as a correction data calculation device. Also, correction process section 60 functions to distinguish optical density unevenness caused by factors of other than the recording head. Further correction process 60 functions to obtain the optical density of the non-recording area in a corrective image on printing paper sheet 2 scanned by flatbed scanner 70, and functions to determine whether there is dirt on printing paper sheet 2 based on the optical density data of the non-recording area.

The functions described above are performed, for example, via a program stored in a memory (not shown) which is executed via a CPU (not shown) in correction process section 60.

Flatbed scanner 70 comprises a light source, CCD (Charge Coupled Device) and an A/D converter. In the image receiving head of flatbed scanner 70, the CCD being a photo-detecting element is disposed in array. The CCD arrangement direction is the direction where more CCD are arranged as shown in FIGS. 2(*a*), 2(*b*) and 2(*c*). In this embodiment, a flatbed scanner is employed as a preferable image reading apparatus from the viewpoint of minimizing and simplifying the apparatus, cost and scanning time, however a flatbed scanner having a photo-detecting elements arranged in a dotted shape or faced shape may be employed as well.

The flatbed scanner obtains information by irradiating lights from a light source onto an image placed on the document reader surface and converts reflected light into electrical signals (analog signals), which are converted into digital data by an A/D converter. The digital data is sent to correction process section 60 as image information. Image information contains the location of read image corresponding to optical density data.

As shown in FIG. 1, once supporting roller 1 has conveyed printing paper sheet 2 being drawn from a roll in the direction shown by an arrow, recording head controller 40 controls the exposure of red recording head 30*a*, green recording head 30*b* and blue recording head 30*c* corresponding to the image data so as to form a latent color image on printing paper 2 by sequentially exposing each color at a predetermined position. After completing the exposing process, supporting drum 1 conveys printing paper sheet 2 to the next process being the developing process. Printing paper sheet 2 is not limited to a rolled paper sheet but it may also alternatively be a individual paper sheets. The conveyance device may also be other devices such as a belt conveyer.

Figure 3:
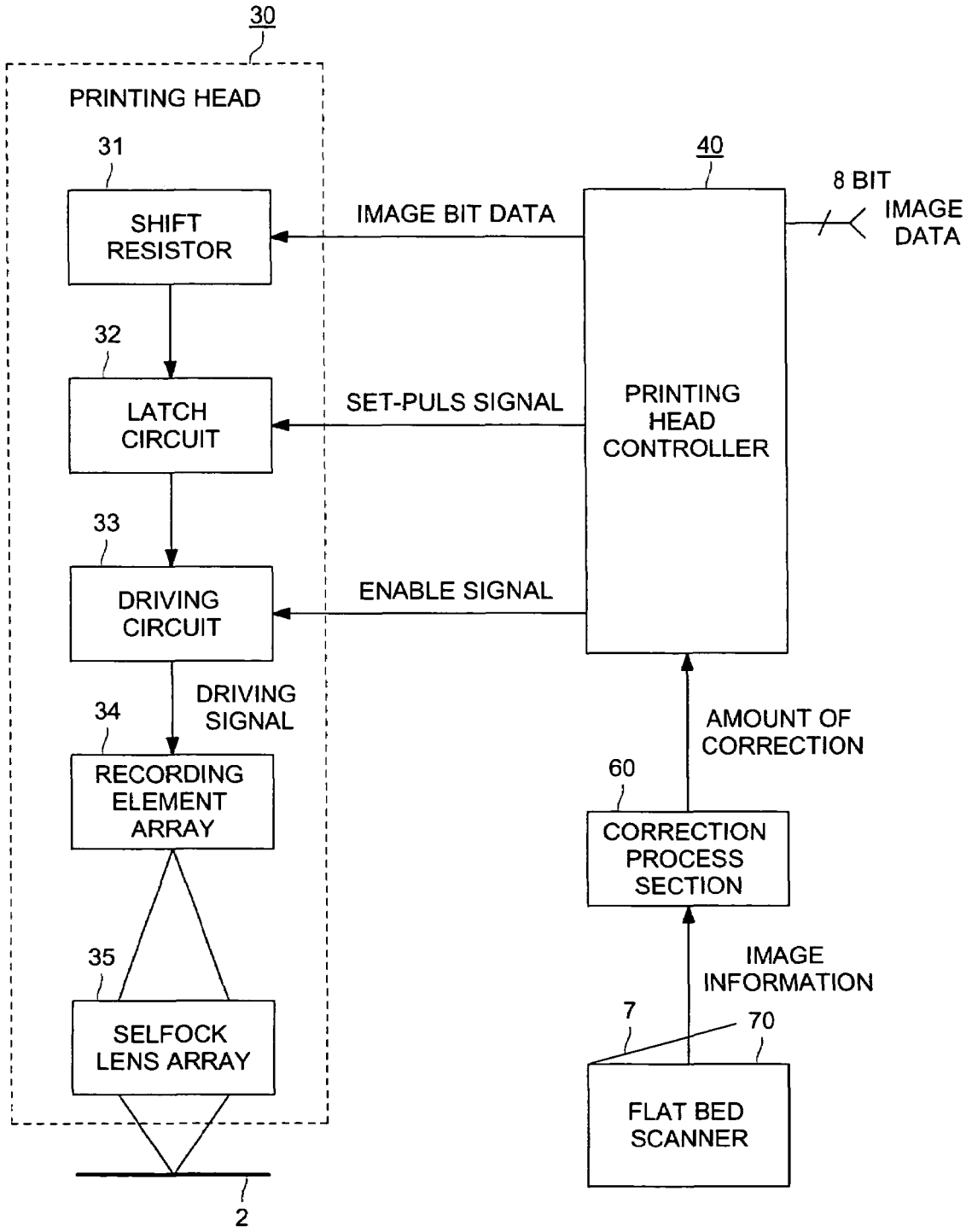
FIG. 3 shows a block diagram of a driving control circuit describing the sequence of image data writing operations of an image forming apparatus.

FIG. 3 shows a block diagram of a driving circuit explaining the writing operation of the image data of one color of recording head 30. As shown in FIG. 3, for example, recording head controller 40 conducts a correction process on image data based on the amount of correction data generated by correction process 60 when the 8-bit image data of each color is inputted, converts the image data into serial digital data being for one line of each recording element corresponding to each recording element, and at the same time generates a set-pulse signal for sending image-bit data to latch circuit 32 and an enable signal for controlling the emitting duration and outputs those signals to recording head 30. Herein, image bit data is a specific bit data of an image data.

Firstly, recording head controller 40 sends the MSB (Most Significant Bit) of the image bit data as an image data for one line to shift resistor 31. When a set pulse signal is inputted to latch circuit 32, which latches MSB data together with one line data synchronized with the set pulse signal. Once an enable signal corresponding to optical density is inputted to driving circuit 33, each recording element of recording head 30 is controlled element by element so as to emits lights corresponding to latched image data for a duration corresponding to the length of the enable signal. Namely, driving circuit 33 selectively outputs a driving signal to the element for which latched data indicates "1" and has the element emit lights for the duration of the length of the enable signal. Emitted lights are focused and form a latent image via a selfock lens onto printing paper sheet 2. This process is sequentially conducted on all bits from MSB to LSB (Least Significant Bit). The process may also be started from LSB to MSB and the bit-order is not limited to this embodiment described above. In this embodiment, the process is described for one color, however the same process applies to all three colors.

Green and blue color resolution filters (not shown) for green recording head 30*b* and blue recording head 30*c* are provided in the lower portion of selfock lens 35.

Next, a corrective image will be described. Printing paper sheet 2 containing the corrective image will be called chart 3 hereinafter. The correction chart shown in FIGS. 4(*a*) and 4(*b*) employs a gray colored image, however it may have three areas each of which contains an image colored in red, green or blue respectively.

Figure 4:
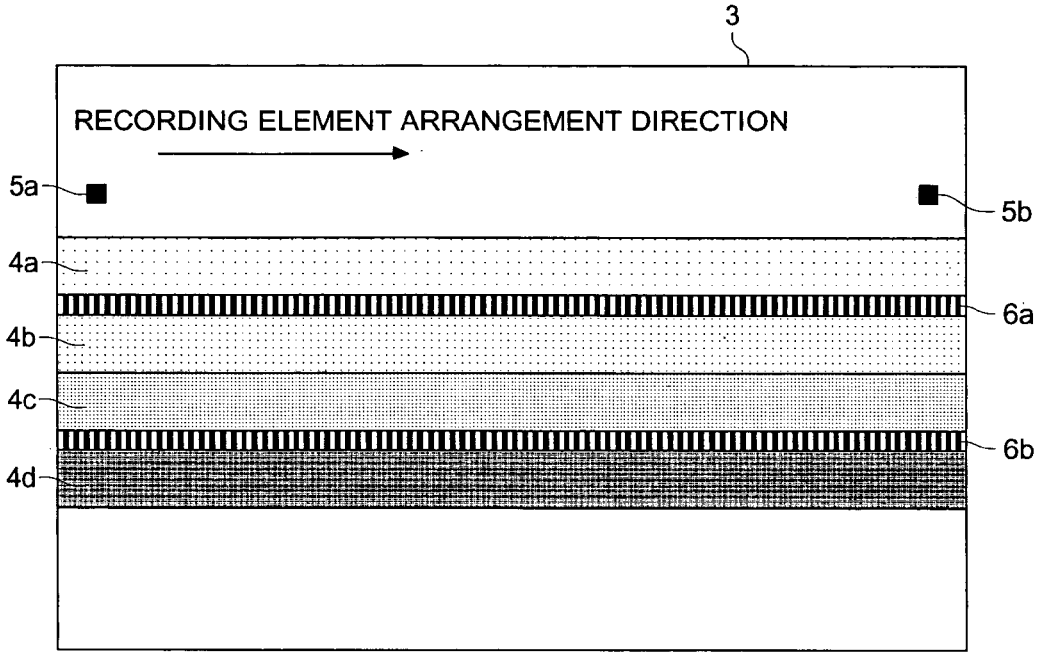
FIGS. 4(*a*) and 4(*b*) show schematics on which a corrected image is recorded.
Figure 4:
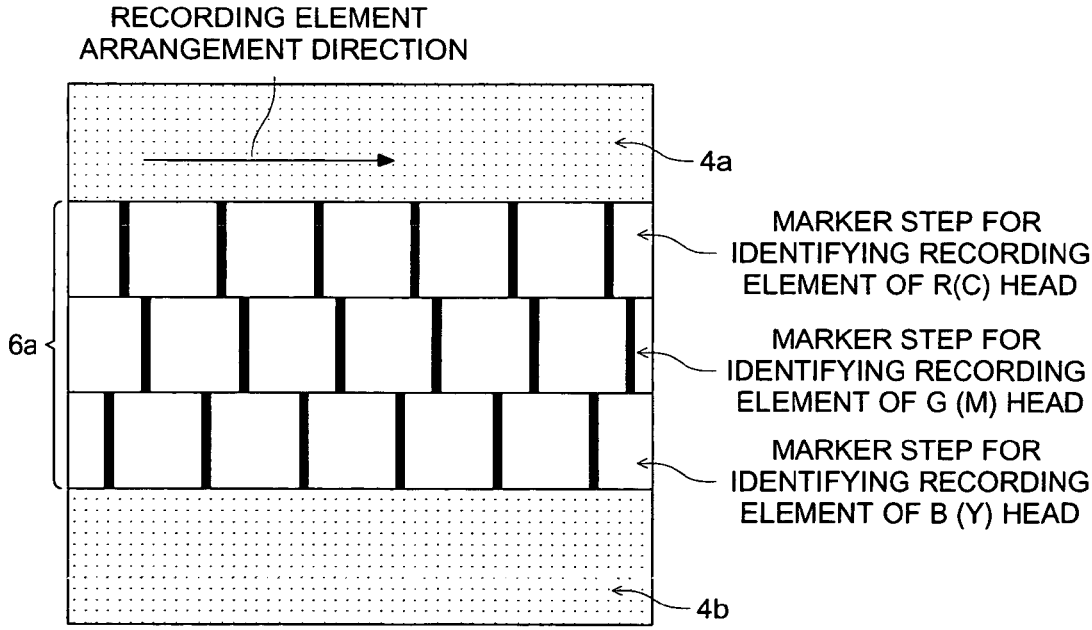

As shown in FIG. 4(*a*), chart 3 employed in this embodiment contains optical density measurement areas 4*a*, 4*b*, 4*c* and 4*d*, tilt-checking markers 5*a* and 5*b* and recording element identifying markers 6*a* and 6*b*. The arrow in FIG. 4(*a*) specifies the recording element arrangement direction.

Optical density areas 4*a*, 4*b*, 4*c* and 4*d* are the portions where optical density is measured in order to unify the exposure of recording elements. For example, a gray colored image is employed for the pattern in chart 3 since when red recording head 30*a*, green recording head 30*b* and blue recording head 30*c* record a pattern on the same portion, basic colors being a cyan dye, a magenta dye and a yellow dye form a gray colored image. As shown in FIG. 4(*a*), it is preferable that a corrective image contains a plurality of image data in a plurality of portions in chart 3. Namely, the corrective image should be recorded at a plurality of optical densities. An example, which contains four kinds of optical density measurement areas 4*a*, 4*b*, 4*c* and 4*d*, is shown in FIG. 4(*a*).

The recorded images in optical density measurement areas 4*a*, 4*b*, 4*c* and 4*d* may be provided at intervals of more than one recording element in the recording element arrangement direction. However a continuous solid image is preferable. Also it is preferable that the optical density in the recording element arrangement direction is substantially uniform.

It is also preferable that optical density measurement areas 4*a*, 4*b*, 4*c* and 4*d* are provided in many locations in as large an area as possible. However, since the larger the corrective image becomes large, the more time takes it to form an image and to read the corrective image, and the more paper sheets are lost, the correction paper sheet size being larger than necessary size requires excessive printing and time. In addition, as the amount of data becomes beyond a predetermined number, results will converge and the data become useless.

It is then desirable that the number of lines recorded on the optical density measurement areas 4*a*, 4*b*, 4*c*, and 4*d*, is equal to or more than 50 and equal to or less than 1000, respectively, and preferably that it is equal to or more than 50 and equal to or less than 200, and further it is still more desirable that it is equal to or more than 60 and equal to or less than 100. Here, the number of lines means the number of pixels being set perpendicularly to the arrangement direction of a recording element. In addition, it is desirable that the optical density measurement is performed by measuring the number of recorded lines which fall in a range being equal to or more than 10% and being equal to or less than 90% of recorded lines to obtain the amount of compensation, but preferably by measuring the number of recorded lines which fall in a range being equal to or more than 20% and being equal to or less than 80% of recorded lines to obtain the amount of correction.

Markers 5*a* and 5*b* for an inclination determination are used to determine the inclination of a corrective image. As shown in FIG. 4(*a*), paired markers 5*a* and 5*b* for an inclination determination are recorded near both ends of chart 3 in the recording element arrangement direction. In addition, since markers 5*a* and 5*b* for an inclination determination are used to know a position, it is desirable that the markers are recorded by a small number of record element with a small number of number of lines, and to be recorded in as small a domain as possible.

Marker stages 6*a* and 6*b* for identifying each recording element are used for identifying the position of each recording element of each recording head 30. The shorter interval of marker stages 6*a* and 6*b* in a recording element arrangement direction, the better. As for the interval of the marker stages 6*a* and 6*b* for identifying recording element, it is desirable to be less than 10 pixels, less than 5 pixels is more desirable, and it is most desirable to be a pixel interval. It means that ON/OFF-operation is repeated in every one pixel in the arrangement direction of a recording element.

In addition, since it is anticipated that there are some errors in the attachment position of recording head 30, it is desirable that each recording head 30 has a monochromatic marker for identifying the recording element. An enlarged view of marker stage 6*a* for identifying the recording element is shown in FIG. 4(*b*). As shown in FIG. 4(*b*), a marker stage (cyan) for identify the position of each recording element of red recording head 30*a*, a marker stage (magenta) for identify the position of and each recording element of green recording head 30*b* and the marker stage (yellow) for identifying the position of and each recording element of blue recording head 30*c* are recorded.

In chart 3, when an optical density measurement domain is recorded on two or more places, it is desirable to record the marker stage for identifying a recording element near the optical density measurement domain.

Figure 5:
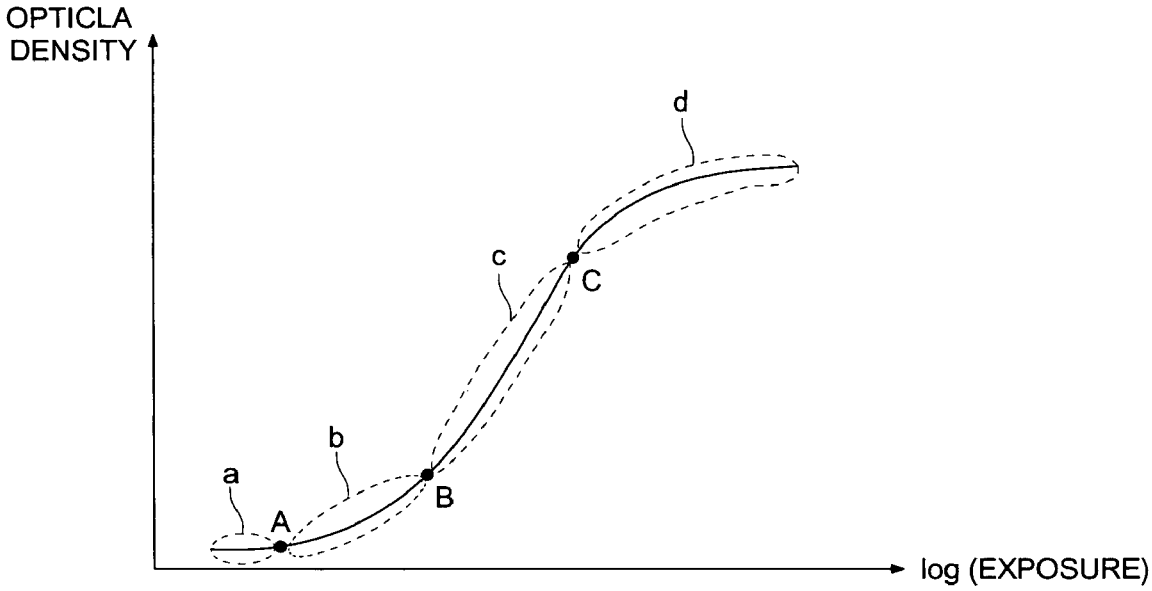
FIG. 5 shows a curve of characteristic of a photographic material.

Optical density measurement domains 4*a*, 4*b*, 4*c*, and 4*d* are images having optical density of the linear portion of the recording characteristic of printing paper sheet 2. As shown in FIG. 5, there are four sections (a-section, b-section, c-section and d-section) in a characteristic curve. A-section is a non-recording section where no optical density increase appears in the characteristic curve even if light acts until the amount of exposure increases beyond a certain value (A points). When the amount of exposure reaches a certain amount of exposure, as the amount of exposure starts increasing, an optical density will begin to increase. From A point to B point the characteristic curve become a curve with a downward convex (section b). From B point to C point, the characteristic curve becomes a substantially linear and the change of optical density against the change of the logarithm of the amount of exposure becomes constant (c section). If the amount of exposure becomes more than C point, the increase of optical density to the increase of the logarithm of the amount of exposure will decrease, and a characteristic curve will turn into an upward convex curve (d section). That is, the change of the optical density of an image against the change of the amount of exposure in c-section (middle optical density) whose characteristic curve is substantially liner is large comparing with a-section, b-section (low optical density) and d-section (high optical density) whose characteristic curve is not a straight line. Therefore, the change of optical density against the change of the amount of exposure becomes remarkable and the difference of optical density unevenness becomes clearer.

When printing paper 2 is a cut-paper sheet being convenient for conveyance, not a roll paper, in order to prevent dirt of development processing liquid, it is preferable that the corrective image is recorded in the center portion of the chart 3 in the conveyance direction, and it is also preferable that the corrective image is not recorded on the top end in the conveyance direction. Further, due to the variations of the top end position of chart 3 when the corrective image is read in a flatbed scanner 70, it is preferable that the corrective image is not recorded in the top end of chart 3 in the conveyance direction.

In regard to the size of chart 3, for example, when printing paper 2 is recorded after being cut, it is preferable that the length (LV) being perpendicular to the recording element arrangement direction of the print head 30 is not so long comparing with the length (LH) in the recording element arrangement direction of recording head 30. From viewpoints, such as the conveyance nature of printing paper 2, loss paper reduction and a development process, it is preferable that LV/LH is less than 2.0, less than 1.2 is more preferable and less than 0.9 is still more preferable. When the image scanning range of an image scanner is smaller than the length of chart 3 in the recording element arrangement direction of chart 3, the image scanner may simultaneously measure a plurality of charts 3(*s*). It is possible to appropriately synthesize the amount of correction obtained from the plurality of chart 3(*s*), when calculating optical density unevenness.

When scanning chart 3 via flatbed scanner 70, chart 3 is securely forced and firmly contacted with the glass surface of a flatbed scanner 70 by pressing member 7. Pressing member 7 means here a holding member to hold chart 3. it is preferable that pressing member 7 has uniform optical density across the pressing surface colored in black. It is also preferable that that the material of pressing member 7 is a soft and easily bent material, for example such as rubber or sponge. Further, it is preferable that electrification property is low and the quality of the material to which dust cannot adhere easily is used. By using pressing member 7, it can prevent carrying out scanning chart 3 being floated on flatbed scanner 7.

Optical density data is obtained for every color of R (red), G (green), and B (blue). By obtaining optical density data for each color, the amount of correction can be adjusted for each color. Since the color of chart 3 shown in FIG. 4 is a color near a gray color, it is preferable to have a device to extract the ingredient of each color of RGB. In regard to the device to extract each color ingredient, the following device is used as a preferable example.

Usually, although an image is formed by dyes in a recording material, it contains not a little ingredient of other colors by which the absorption curve of each dye has overlapped, and/or a sub-absorption belt exists. Even if optical density unevenness for a main-ingredient color is good, when the optical density unevenness of other colors is very inferior, it may apply the correction which should feed back to a recording head of other colors to the recording head of the main ingredients. For this reason, optical density unevenness may occur as correction is performed, and the number of times of correction may increase until it converges to the state where there is no optical density unevenness.

Then, when optical density unevenness for other colors is inferior, performing color conversion can eliminate it and exact and highly precise correction can be attained.

The color conversion here means to extract each ingredient of RGB based on the information acquired in the state that three colors of RGB are mixed together. Although the color conversion may be conducted in any conversion method, when conducting the color conversion, it is preferable to use a following conversion formula (1) where, read optical densities before color conversion, namely, integration optical densities are set as $R_{org}$, $G_{org}$ and $B_{org}$ and optical densities after the color conversion, namely analyzed optical density set as R', G' and B'.

$$R'=ar\cdot(R_{org})^{br}+cr\cdot(G_{org})^{dr}+er\cdot(B_{org})^{fr}+gr$$

$$G'=ag\cdot(R_{org})^{bg}+cg\cdot(G_{org})^{dg}+eg\cdot(B_{org})^{fg}+gg$$

$$B'=ab\cdot(R_{org})^{bb}+cb\cdot(G_{org})^{db}+eb\cdot(B_{org})^{fb}+gb \quad (1$$

Where, ar, br, . . . , gb are constants. It is preferable for these constants to be changed corresponding to the recording conditions of a recording material, development processing conditions, the terms and conditions of an image reading apparatus, etc.

Further, it is preferable that a linear conversion formula is used for the color conversion. The linear conversion-formula here means that constants br, fr, bg, dg, fg, bb and fb are 1 in the conversion formula (1). It is also preferable that in a formula (2) shown below, constant terms gr, gg and gb are 0 (zero).

$$R'=ar\cdot R_{org}+cr\cdot G_{org}+er\cdot B_{org}$$

$$G'=ag\cdot R_{org}+cg\cdot G_{org}+eg\cdot B_{org}$$

$$B'=ab\cdot R_{org}+cb\cdot G_{org}+eb\cdot B_{org} \quad (2)$$

Although a conversion formula is simplified, shortening of calculation time and exact and highly precise correction are simultaneously realizable by adjusting constant ar, cr, . . . , eb.

It is preferable to perform color conversion of the information being scanned of the corrective image after a setup which is an adjustment of a color-balance, is completed from a viewpoint of the improvement of correction accuracy. A setup of color-balance means to adjust the average value of the amount of records of each recording head or the amount of exposure etc., in order to adjust color-balance of each recording heads for every basic color so that it may become desired optical density to the image data of each basic color.

An optical density unevenness correction process being performed by image forming apparatus 10 of this invention will be described. The optical density unevenness correction process is performed to reduces variation in the record characteristic of each record element of print head 30 and to obtains uniform amount of exposure. In the present invention, performed is the optical density unevenness correction process which prevents reverse correction performed based on the unevenness of optical density caused by the factor not being associated with a recording head.

Figure 6:
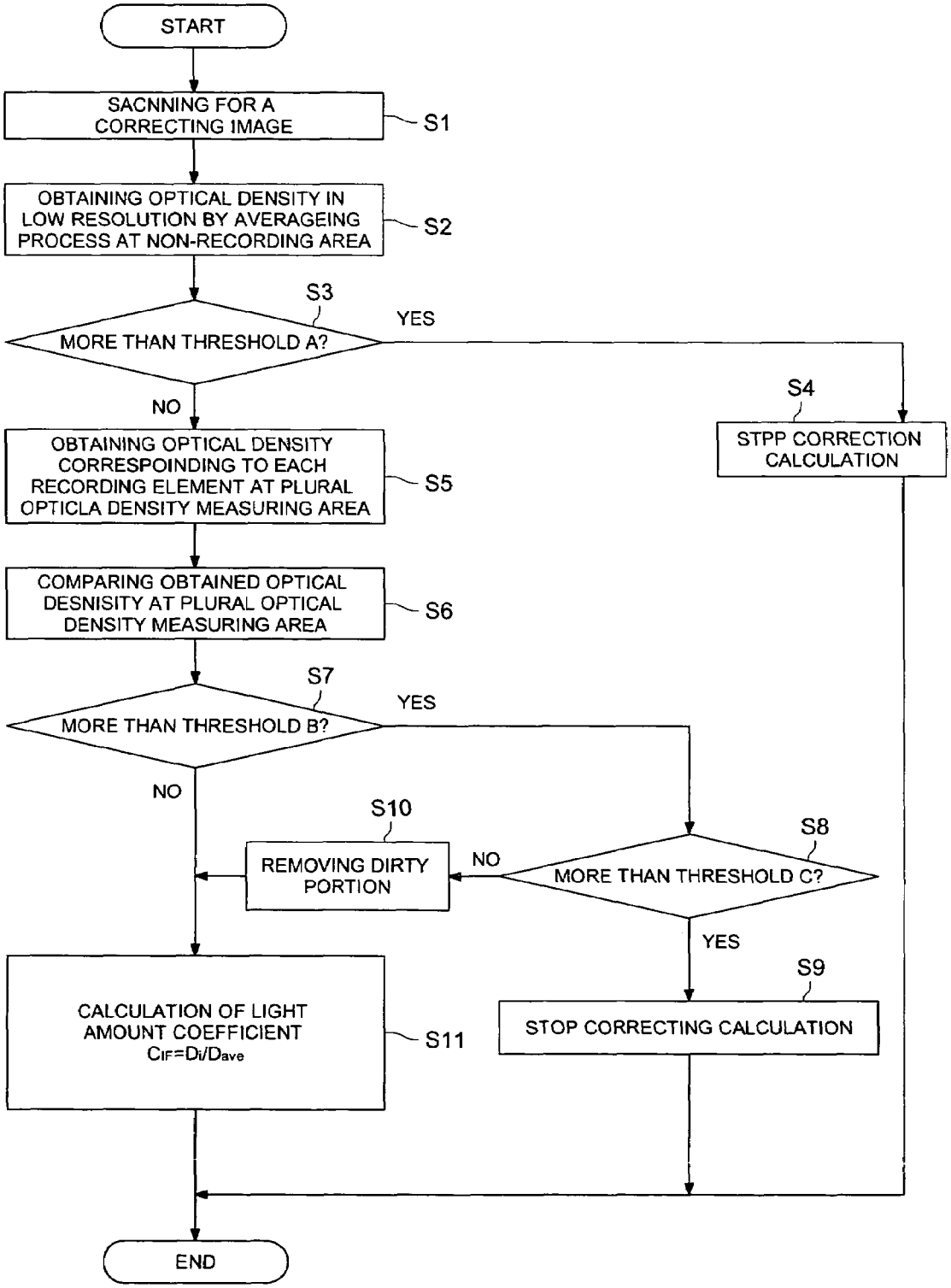
FIG. 6 is a flowchart for the optical density unevenness correction process of an image forming apparatus.

As shown in FIG. 6, chart 3 on which a corrective image is recorded is set on flatbed scanner 70. The flatbed scanner scans the corrective image and optical density is measured (Step S1). Namely, image information is acquired from the corrective image. Specifically, optical density data corresponding to each basic colors R, G and B in each position in the corrective image is obtained and outputted to correction process section 60.

Subsequently, optical density of a non-recorded portion in chart 3 is measured with the resolution which is lower than the resolution by which the corrective image is scanned by averaging several data (Step 2).

A resolution corresponding to the lower resolution than the resolution by which the corrective image is scanned means that, for example when the resolution by which the corrective image is scanned at resolution of 1200 dpi (dot per inch), the resolution is 400 dpi, 300 dpi or less. Optical density data may be obtained without lowering resolution. However optical density data can be obtained more efficiently in a short time by lowering resolution. Also, when dirt has adhered to chart 3 and optical density unevenness has occurred, since it is anticipated that the optical density unevenness spreads over a certain area, the optical density unevenness can be detected in low resolution. And a judgment process of step 3 may be conducted based on the image information obtained by performing a scan in relatively low resolution.

After that, correction process section 60 compares the optical density data of non-recorded portion of the corrective image with a threshold value and determines whether optical density unevenness caused by the adhesion of dirt occurs in non-recorded potion of the corrective image which corresponds to the optical density (Step 3). Namely, when the optical density is equal to or more than threshold A (Step 3: YES) correction process section 60 determines that optical density unevenness caused by the adhesion of dirt appears in the non-recorded area of the corrective image and when the optical density is lower than threshold A (Step 3: No), correction process section 60 determines that optical density unevenness caused by the adhesion of dirt does not appear in the non-recorded area of the corrective image.

Although the comparison may be conducted by comparing the optical density data obtained by measuring non-recorded area of the corrective image with a predetermined threshold A, the comparison also may be conducted by comparing the average value calculated by using the statistic value of optical density for the non-recorded area with threshold A. It is also possible to determine whether optical density unevenness appears by calculating the difference between the obtained optical density data and threshold A.

When correction process section 60 determines that if the optical density data of the non-recorded area is equal to or more than threshold A (step 3: Yes), then correction process section 60 stops a correction calculation (Step 4). When correction process section 60 stops the correction calculation, alarm is issued to tell that the correction calculation is stopped and/or a message for promoting to repeat the prevention of a reverse correction process is displayed so that an operator can aware of it.

On the other hand, if correction process section 60 determines that optical density data of the non-recorded domain is less than threshold A (Step S3; No) the process moves to step S5.

In step S5, correction process section 60 specifies the optical density data corresponding to each recording element in a plurality of optical density measurement areas 4*a*, 4*b*, 4*c* and 4*d*. Then correction process section 60 compares the optical density data of each element obtained in a plurality of optical density measurement areas 4*a*, 4*b*, 4*c* and 4*d* and calculates the difference data in each optical density measurement area (Step S6).

If no optical density unevenness caused by the factor originating from dirt occurs in optical density measuring area, the difference data or the difference of optical densities in each optical density measurement area indicates substantially constant value. If optical density unevenness exists, the difference data corresponding to recording elements in the area where optical density unevenness occurs indicates a plus or minus value.

Subsequently, correction process section 60 compares the difference data with threshold B as a first threshold value to determine whether optical density unevenness in optical density area 4*a*, 4*b*, 4*c* or 4*d* is caused by the adhesion of dirt to chart 3 (Step S7).

Namely, if the absolute value of difference data is less than threshold B (Step S7; No), then it is determined that it is within an error range while if the absolute value of difference data is equal to or more than threshold value B (Step S7; Yes), then it is determined that optical density unevenness is caused by the adhesion of dirt to chart 3.

Although it is possible to detect optical density unevenness caused by dirt by using difference data obtained by comparing the optical density data of each recording element in each measurement area which is obtained in plural optical density areas 4*a*, 4*b*, 4*c* and 4*d*, it is also possible to detect the optical density unevenness by using the average difference data calculated by obtaining the difference between an average value calculated by using the statistics value of all optical density data in each optical density measurement area and optical density data of each recording element.

For example, in optical density measurement area 4*a*, it is possible to determine high or low in optical density of a specified area by obtaining the difference data which is the difference between the average value of optical density of all optical density measurement area corresponding to the recording elements arranged in array and the optical density of area 4*a*' arranged by specified recording elements (not shown).

In this case, since it is possible to obtain the average difference data in regard to optical density unevenness associated with a recording head, high data reliability or certainty can be assured by determining the cause of optical density unevenness by comparing the average optical density data of each optical density measurement area to average difference data obtained in each optical density measurement areas 4*a*', 4*b*', 4*c*' and 4*d*' corresponding to the specified recording elements (not show) in the recording elements. This comparison has to be done between more than two different optical measurement areas. However, higher accuracy can be obtained by conducting the comparison in all optical density measurement areas.

When correction process section 60 determines that the absolute value of difference data is less than threshold B (Step S7: No), the process moves to step 11. When it is equal to or more than threshold B (Step S7: Yes), the process moves to step S8.

In step S8, correction process section 60 compares the absolute value of difference data with threshold C as a second threshold (Step S8).

Threshold C is a higher value than that of threshold B. If correction process section 60 determines that the absolute value of difference data is larger than threshold C (Step S8; Yes), then correction process section 60 estimates that optical density unevenness in optical density measurement areas 4*a*, 4*b*, 4*c* or 4*d* is caused by adhesion of especially extreme dirt, and in this case, correction process section 60 stops the correction calculation (Step S9).

If the absolute value of difference data is equal to or more than threshold B and less than threshold C (Step S8; No), correction process section 60 removes optical density data associated with unevenness caused by the adhesion of dirt and the process moves to step 11.

Here, "remove" is performed by replacing optical density data ($D_i$) of a pixel having a pixel number (i) in which adhesion of dirt is recognized with an average value ($D_{ave}$) of optical density of each element in the arrangement direction.

In step S11, correction process section 60 conducts the correction calculation. The correction calculations concretely means to obtain a correction value ($C_i$) [NUMBER 1 shown below] obtained by dividing each optical density ($D_i$) by the means value ($D_{ave}$) of the optical density of each pixel deployed in the arrangement direction.

$$C_i = D_i / D_{ave} \qquad \text{NUMBER 1}$$

The correction coefficient of the amount of light is obtained based on correction value calculated by formula shown above (Step 11), then the process is completed.

Figure 7:
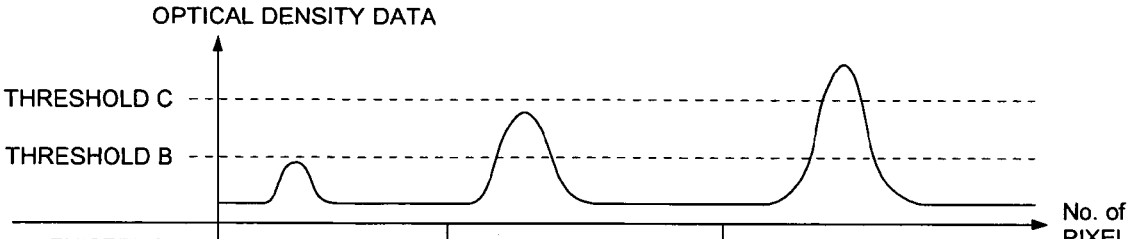
FIG. 7 shows the execution steps of an optical density unevenness correction process being carried on by an image forming apparatus based on the amount of dirt.

As shown in FIG. 7, correction process section 60 determines whether there is dirt in chart 3 which corresponds to a pixel number by conducting the correction processes described above. FIG. 7 shows the correction steps of optical density unevenness process which is executed by an image forming apparatus. The correction step is divided into three cases based on the degree of dirt. In FIG. 7, a horizontal axis represents the difference of optical densities being corresponding to each pixel in optical density measurement areas 4*a* and 4*b*. However optical density data in other optical density measurement areas may be used.

The image forming apparatus is designed to issue an alarm telling that the calculation has stopped when the correction calculation is stopped and/or to advice for newly conducting another optical density correction process by using another new printing paper sheet so that an operator is aware of it.

As described above, according to image forming apparatus 10 of the embodiment of the present invention, it become possible to prevent a reverse correction which is a correction based on optical density unevenness caused by dirt, which should not be conducted, by removing optical density unevenness caused by factors other than recording head 30 or stopping a corrective calculation, when calculating the amount of correction of recording characteristic for each recording element.

It also becomes possible to make a reliable judgment by discriminating optical density unevenness by using the statistic value of optical density and/or optical density data in a plurality of optical density measurement areas.

Further, it becomes possible to realize an easy and assured judgment by determining that optical density unevenness is caused by factors associated with recording head 30 or dirt by using a threshold value.

Further, judgment criteria become clear and it become possible to make a easy judgment since a plurality of thresholds is used to calculate the amount of correction.

When dirt adheres on chart 3, it becomes possible to prevent a reverse correction which should not be conducted, namely, a calculation of the amount of correction based on the optical density unevenness caused by dirt, by stopping the calculation of the amount of correction.

Further, it becomes possible to clearly recognize optical density unevenness, an image is formed by using the linear portion of a recording characteristic curve of printing paper sheet 2.

The judgment of the edge portion of an image not only can be assured but also suppresses the floating of the image by using pressing member 7.

Further, it is possible to adjust the amount of correction for each color by obtaining optical density of each color of R, G and B.

A preferable embodiment of the present invention is described above and it not limited to this embodiment. In regard to detailed structure and operation of the image forming apparatus can be changed and modified without departing from the scope of the invention as set forth below.

For example, a recording head having a recording element arranged in array may have a plurality of recording elements arrange in one line or plural lines with a predetermined interval in order to obtain desired resolution. Followings are examples of the preferable recording head arranged in array which are lighting devices containing deployed LEDs (Light Emitting Diode) or vacuum fluorescence light tubes, a PLZT recording head having a suitable back light and a liquid crystal shutter array recording head, a device having the semiconductor laser in array, a thermal head, and a lighting device using an electro-luminescence phenomenon such as an organic EL material.

In regard to the image forming apparatus, the preferable apparatus are an apparatus capable of forming an image containing a plurality of optical densities which records images onto a silver halide photosensitive material by using each recording element arranged in array, the apparatus for recording images by using a thermal head with a sublimation type ink and an ink-jet recording apparatus, etc.

In the embodiment described above, optical density data is used as information obtained from an image. However the readout information is not limited to optical density but can be data indirectly indicating optical density such as reflection coefficient, a transmitting coefficient or a light absorption coefficient or a functional value corresponding to them.

What is claimed is:

1. A method of forming an image employing an image reading device and a recording head having a plurality of recording elements arranged in array, the method comprising the steps of:

recording a corrective image onto a recording material;

acquiring readout information from the corrective image read by the reading device;

carrying out a calculation to obtain an amount of a correction for recording characteristics, each of which corresponds to each of the plurality of recording elements, from the readout information acquired in the acquiring step; and forming an image onto the recording material by the recording head in which the plurality of recording elements are compensated based on the amount of correction in the carrying out step;

wherein, the readout information in the acquiring step discriminates optical density unevenness caused by a factor not being associated with the recording head based on the readout information, and wherein, the amount of the correction is calculated without optical density unevenness when the optical density unevenness caused by a factor not being associated with the head is identified.

2. The method of claim 1, wherein, the optical density unevenness is discriminated based on a statistic value of the readout information.

3. The method of claim 2, wherein, the optical density unevenness is discriminated based on a determination whether the readout information is equal to or more than a predetermined threshold.

4. The method of claim 3, wherein, the optical density unevenness is discriminated based on a comparison of the readout information obtained from different areas of the recording material.

5. The method of claim 4, wherein, the optical density unevenness is discriminated based on whether differences of the readout information obtained from different areas of the recording material are more than a predetermined threshold.

6. The method of claim 5, wherein, the optical density as the readout information of recording area of the corrective image is set in a linear section of a characteristic curve of the recording material.

7. The method of claim 6, wherein, the recording material is fixed onto the image reading device by a pressing member.

8. The method of claim 7, wherein, the readout information are color ingredient information of three colors R, G and B.

9. The method of claim 2, wherein, the optical density unevenness is discriminated based on a comparison of the readout information obtained from different areas of the recording material.

10. The method of claim 9, wherein, the optical density unevenness is discriminated based on whether differences of the readout information obtained from different areas of the recording material are more than a predetermined threshold.

11. A method of forming an image employing an image reading device and a recording head having a plurality of recording elements arranged in array the method comprising the steps of:

recording a corrective image onto a recording material;

acquiring readout information from the corrective image read by the reading device;

carrying out a calculation to obtain an amount of a correction for recording characteristics, each of which corresponds to each of the plurality of recording elements, from the readout information acquired in the acquiring step; and forming an image onto the recording material by the recording head in which the plurality of recording elements are compensated based on the amount of correction in the carrying out step;

wherein, the readout information in the acquiring step discriminates optical density unevenness caused by a factor not being associated with the recording head based on the readout information, and wherein, the calculation of the amount of the correction is stopped when optical density unevenness caused by not being associated with the recording head is identified.

12. The method of claim 11, wherein, the optical density unevenness is discriminated based on a statistic value of the readout information.

13. The method of claim 12, wherein, the optical density unevenness is discriminated based on a determination whether the readout information is equal to or more than a predetermined threshold.

14. The method of claim 13, wherein, the optical density unevenness is discriminated based on a comparison of readout information obtained from different areas of the recording material.

15. The method of claim 14, wherein, the optical density unevenness is discriminated based on whether differences of the readout information obtained from different areas of the recording material are more than a predetermined threshold.

16. The method of claim 15, wherein, the optical density as the readout information of recording area of the corrective image is set in a linear section of a characteristic curve of the recording material.

17. The method of claim 16, wherein, the recording material is fixed onto the image reading device by a pressing member.

18. The method of claim 17, wherein, the readout information are color ingredient information of three colors R, G and B.

19. The method of claim 12, wherein, the optical density unevenness is discriminated based on a comparison of the readout information obtained from different areas of the recording material.

20. The method of claim 19, wherein, the optical density unevenness is discriminated based on whether differences of the readout information obtained from different areas of the recording material are more than a predetermined threshold.

21. A method of image forming employing an image reading device and a recording head having a plurality of recording elements arranged in array, the method comprising the steps of:

recording a corrective image onto a recording material;

acquiring readout information of non-recorded section of the recording material on which the corrective image is recorded which is read by the image reading device;

determining whether there is dirt in the non-recorded section of the recording material on which the corrective image is recorded based on the readout information;

carrying out a calculation to obtain an amount of correction when determined that there is no dirt in the recording material on which the corrective image is recorded;

stopping the calculation when determined that there is dirt in the recording material on which the corrective image is recorded; and forming an image onto the recording material by the recording head in which the plurality of recording elements are compensated based on the amount of correction in the carrying out step.

22. The method of claim 21, wherein, the determining step is to be performed based on a statistic value of the readout information.

23. The method of claim 21, wherein, the determining step is to be performed when the readout information is larger than a predetermined threshold.

24. An image forming apparatus comprising:

a recording head having a plurality of recording elements arranged in array, the recording head being utilized for recording a corrective image onto a recording material;

an image reading device to acquire readout information by reading the corrective image;

an carrying out section to conduct calculation to obtain an amount of a correction of recording characteristics, each of which corresponds to each of the plurality of recording elements, from the readout information acquired by the reading device;

an image forming section to form an image onto the recording material by the recording head in which a recording characteristics of the plurality of recording elements are compensated based on the amount of correction in the carrying out section; and a controller to control the recording head so as to record the corrective image on to the recording material;

wherein, the readout information in the carrying out section discriminates optical density unevenness caused by a factor not being associated with the recording head, and wherein, the amount of the correction is calculated without optical density unevenness when the optical density unevenness caused by a factor not being associated with the recording head is identified.

25. The image forming apparatus of claim 24, wherein, the optical density unevenness is discriminated based on a statistic value of the readout information.

26. The image forming apparatus of claim 25, wherein, the optical density unevenness is discriminated based on a determination whether optical density in the readout information is equal to or more than a predetermined threshold.

27. The image forming apparatus of claim 26, wherein, the optical density unevenness is discriminated based on a comparison of optical density in the readout information obtained from different areas of the recording material.

28. The image forming apparatus of claim 27, wherein, the optical density unevenness is discriminated based on whether differences of readout information obtained from different areas of the recording material is more than a predetermined threshold.

29. The image forming apparatus of claim 28, wherein, the optical density in the readout information of recording area of the corrective image is set in a linear section of a characteristic curve of the recording material.

30. The image forming apparatus of claim 29,
wherein, the recording material is fixed onto the image reading device by a pressing member.

31. The image forming apparatus of claim 30,
wherein, the readout information contains color ingredient information of three colors R, G and B.

32. The image forming apparatus of claim 25,
wherein, the optical density unevenness is discriminated based on a comparison of optical density in the readout information obtained from different areas of the recording material.

33. The image forming apparatus of claim 32,
wherein, the optical density unevenness is discriminated based on whether differences of readout information obtained from different areas of the recording material is more than a predetermined threshold.

34. An image forming apparatus comprising:
a recording head having a plurality of recording elements arranged in array, the recording head being utilized for recording a corrective image onto a recording material;
an image reading device to acquire readout information by reading the corrective image;
an carrying out section to conduct calculation to obtain an amount of a correction of recording characteristics, each of which corresponds to each of the plurality of recording elements, from the readout information acquired by the reading device;
an image forming section to form an image onto the recording material by the recording head in which a recording characteristics of the plurality of recording elements are compensated based on the amount of correction in the carrying out section; and
a controller to control the recording head so as to record the corrective image on to the recording material;
wherein, the readout information in the carrying out section discriminates optical density unevenness caused by a factor not being associated with the recording head, and
wherein, the calculation of the amount of the correction is stopped when optical density unevenness caused by not being associated with the recording head is identified.

35. The image forming apparatus of claim 34,
wherein, the optical density unevenness is discriminated based on a statistic value of the readout information.

36. The image forming apparatus of claim 35,
wherein, the optical density unevenness is discriminated based on a determination whether optical density in the readout information is equal to or more than a predetermined threshold.

37. The image forming apparatus of claim 36,
wherein, the optical density unevenness is discriminated based on a comparison of optical density in the readout information obtained from different areas of the recording material.

38. The image forming apparatus of claim 37,
wherein, the optical density unevenness is discriminated based on whether differences of readout information obtained from different areas of the recording material is more than a predetermined threshold.

39. The image forming apparatus of claim 38,
wherein, the optical density in the readout information of recording area of the corrective image is set in a linear section of a characteristic curve of the recording material.

40. The image forming apparatus of claim 39,
wherein, the recording material is fixed onto the image reading device by a pressing member.

41. The image forming apparatus of claim 40,
wherein, the readout information contains color ingredient information of three colors R, G and B.

42. The image forming apparatus of claim 35,
wherein, the optical density unevenness is discriminated based on a comparison of optical density in the readout information obtained from different areas of the recording material.

43. The image forming apparatus of claim 42,
wherein, the optical density unevenness is discriminated based on whether differences of readout information obtained from different areas of the recording material is more than a predetermined threshold.

44. An image forming apparatus comprising:
a recording head having a plurality of recording elements arranged in array, the recording head being utilized for recording a corrective image onto a recording material;
an image reading device to acquire readout information by reading the corrective image;
a device for determining whether there is dirt in the non-recorded section of the recording material on which the corrective image is recorded based on the readout information;
a device for carrying out a calculation to obtain an amount of correction when determined that there is no dirt in the recording material on which the corrective image is recorded;
a device for stopping the calculation when determined that there is dirt in the recording material on which the corrective image is recorded; and
an image forming section to form an image onto the recording material by the recording head in which the recording characteristics of the plurality of recording elements are compensated on the amount of correction in the device for carrying out.

45. The image forming apparatus of claim 44,
wherein, the image correction unit determines whether there is dirt on the recording material based on a statistic value of the readout information.

46. The image forming apparatus of claim 44,
wherein, the image correction unit determines that there is dirt on the recording material when the readout information is larger than a predetermined threshold.

* * * * *